United States Patent [19]

Kondo et al.

[11] Patent Number: 5,058,553

[45] Date of Patent: Oct. 22, 1991

[54] VARIABLE-DISCHARGE HIGH PRESSURE PUMP

[75] Inventors: Shigeyuki Kondo, Aichi; Yoshihisa Yamamoto, Kariya, both of Japan

[73] Assignee: Nippondenso Co., Ltd., Kariya, Japan

[21] Appl. No.: 439,669

[22] Filed: Nov. 22, 1989

Related U.S. Application Data

[63] Continuation-in-part of Ser. No. 462,870, Jan. 8, 1990, which is a continuation of Ser. No. 244,823, Sep. 15, 1988, abandoned.

[30] Foreign Application Priority Data

Nov. 24, 1988 [JP] Japan ..... 63-296990
Dec. 28, 1988 [JP] Japan ..... 63-329371

[51] Int. Cl.[5] ..... F02M 41/00

[52] U.S. Cl. ..... 123/456; 123/458; 123/446; 123/501

[58] Field of Search ..... 123/456, 497, 506, 496, 123/458, 501, 446, 447

[56] References Cited

U.S. PATENT DOCUMENTS

| | | | |
|---|---|---|---|
| 3,545,352 | 10/1985 | Jourde et al. . | |
| 4,491,111 | 1/1985 | Eheim | 123/458 |
| 4,586,480 | 5/1986 | Kobayashi | 123/506 |
| 4,610,233 | 9/1986 | Kushida | 123/458 |
| 4,633,837 | 1/1987 | Babitzka et al. . | |
| 4,653,455 | 3/1987 | Eblen et al. . | |
| 4,719,889 | 1/1988 | Amann et al. . | |
| 4,753,212 | 6/1988 | Miyaki et al. . | |
| 4,757,795 | 7/1988 | Kelly . | |
| 4,777,921 | 10/1988 | Miyaki et al. . | |
| 4,784,101 | 11/1988 | Iwanaga et al. . | |
| 4,884,549 | 12/1989 | Kelly . | |

FOREIGN PATENT DOCUMENTS

| | | | |
|---|---|---|---|
| 0243339 | 10/1987 | European Pat. Off. . | |
| 0243871 | 11/1987 | European Pat. Off. . | |
| 0244340 | 11/1987 | European Pat. Off. . | |
| 277678 | 4/1929 | Fed. Rep. of Germany | 123/496 |
| 2446805 | 4/1976 | Fed. Rep. of Germany . | |
| 3523536 | 3/1986 | Fed. Rep. of Germany . | |
| 3716524 | 11/1987 | Fed. Rep. of Germany | 123/496 |
| 59-165858 | 9/1984 | Japan . | |
| 2165895 | 4/1986 | United Kingdom . | |

*Primary Examiner*—Carl Stuart Miller
*Attorney, Agent, or Firm*—Cushman, Darby & Cushman

[57] ABSTRACT

A variable-discharge high pressure pump for pressure-feeding fuel to a common rail for use in a diesel engine. The pump has a plunger, a plunger chamber, a cam for reciprocatively moving the plunger; and opening-out type electromagnetic valve capable of opening and closing one end of the plunger chamber, a fuel reservoir, a check valve communicating with the plunger chamber, and an inlet pipe for supplying fuel to the fuel reservoir. Both the introduction of the fuel into the plunger chamber and the return of the fuel from the plunger chamber to the fuel reservoir are effected through the electromagnetic valve.

11 Claims, 12 Drawing Sheets

VARIABLE-DISCHARGE HIGH PRESSURE PUMP

CROSS REFERENCE TO RELATED APPLICATIONS

This application is a Continuation-in-Part of application Ser. No. 07/462,870 filed Jan. 8, 1990, now allowed, which was a continuation of application Ser. No. 07/244,823 filed Sept. 15, 1988, now abandoned.

BACKGROUND OF THE INVENTION

This invention relates to a variable-discharge high pressure pump (hereinafter sometimes referred to as "high pressure pump") for supplying a fuel under pressure to a common rail of a diesel engine and also relates to a method of controlling the pump.

Conventional variable-discharge high pressure pumps have a construction for supplying a fuel to a common rail of a diesel engine which construction includes: a plunger; a plunger chamber in which the plunger is movably accommodated; a cam for making the plunger move reciprocatively; an electromagnetic valve which is opened out toward the interior of the plunger chamber; a reservoir which communicates with the plunger chamber through the electromagnetic valve; a check valve which communicates with the plunger chamber and is capable of opening at a predetermined pressure; and an inlet pipe through which the fuel is supplied at a low pressure to the fuel reservoir.

One structural feature of this type of conventional high pressure pump resides in that a part of a low pressure fuel supplied through the inlet pipe is supplied to the reservoir while another part of the low pressure fuel is supplied to the plunger chamber. That is, a fuel inlet which opens into the plunger chamber and an outlet of the plunger chamber through which a part of the fuel is returned to the fuel reservoir are formed separately from each other. If in this high pressure pump the electromagnetic valve malfunctions by being fixed in a closed state, the flow of the fuel ejected through the check valve cannot be controlled. In such an event, there is a risk of the pressure in the common rail abruptly increasing and exceeding a limit pressure determined according to the strengths of the engine and the fuel injector and to the conditions for safety, resulting in damage to the members of the fuel injector.

SUMMARY OF THE INVENTION

It is an object of the present invention to provide a high pressure pump having a specific construction designed for eliminating the possibility of the fuel being supplied to the common rail at an excessively high pressure even if the electromagnetic valve malfunctions, as well as to provide a method of controlling this high pressure pump.

In a variable-discharge high pressure pump of the above-described construction in accordance with the present invention, the plunger chamber and the inlet pipe communicate with each other through the fuel reservoir and the electromagnetic valve, and both the introduction of the low pressure fuel into the plunger chamber and the return of the low pressure fuel from the plunger chamber to the fuel reservoir are effected through the electromagnetic valve.

In a control method in accordance with the present invention, both the introduction of the low pressure fuel into the plunger chamber and the return of the low pressure fuel from the plunger chamber to the fuel reservoir are effected mainly through the electromagnetic valve, and the fuel pressure in the common rail is controlled by energization and de-energization of the electromagnetic valve.

In accordance with one embodiment of the present invention, the cam of the variable-discharge high pressure pump is a non-constant-speed cam having a cam profile such that the cam velocity is maximized during the period of time corresponding to the first half of the stroke of the plunger for pressuring and pressure-feeding the fuel contained in said plunger chamber.

In accordance with one embodiment of the method of the present invention, the electromagnetic valve is energized to be closed if the rate at which the pressure in the common rail changes becomes positive while the electromagnetic valve is open in the non-energized state.

In accordance with another embodiment of the method of the present invention, a pulse signal asynchronous with the rotation of the diesel engine and determining an energization time ($T_1$) and a de-energization time ($T_2$) is applied to the electromagnetic valve when the diesel engine is started.

In this control method, the energization time $T_1$ and the non-energization time $T_2$ are determined by the following equations:

$$T_1 = T_3 + T_c$$

$$T_2 = \frac{Q_{max}}{C \cdot S \cdot \sqrt{P_f - P_k}} + T_0 - T_c$$

where $T_3$: a period of time required to increase the pressure to a level high enough to maintain the electromagnetic valve in the closed state by lifting the plunger from the bottom dead point during a minimum-speed rotation for starting the engine;

$T_c$: valve closing time delay after the moment at which the electromagnetic valve is energized;

$Q_{max}$: a maximum discharge from the high-pressure pump;

C: a constant determined by factors including the viscosity of the fuel;

S: the flow passage area;

$P_f$: supplied fuel pressure;

$P_k$: pressure in the plunger chamber; and $T_0$: valve opening time delay after the moment at which the electromagnetic valve is de-energized.

According to the variable-discharge high pressure pump of the present invention and the method of controlling this pump, if a valve accident takes place in which the valve plug of the electromagnetic valve of the high pressure pump is fixed to the valve seat in a valve closing state, the supply of the low pressure fuel to the plunger chamber is stopped so that the common rail is supplied with no fuel. There is therefore no possibility of the fuel pressure in the common rail increasing and no possibility of damage to the members of the fuel injector of the engine.

In the high pressure pump in accordance with the above embodiment of the present invention, the non-constant-velocity cam is designed to set a high cam velocity for the first half of the up-stroke and, hence, a high plunger lifting speed, thereby ensuring that the pressure in the plunger chamber can be increased to a level high enough to maintain the opening-out type electromagnetic valve in the closed state in a short time at an initial stage of the up-stroke. Even if the electromagnetic valve closing control time is reduced for high speed operation, a high pressure fuel can be discharged at a sufficiently large rate in a low speed range in which a large discharge is required to promptly produce and maintain the common rail pressure or, more specifically, in a super-low-speed range for starting, since the fuel pressure can be increased to a high level in a short time.

According to the above-mentioned one embodiment of the method of the present invention, in a case where the return spring of the electromagnetic valve is broken, the electromagnetic valve can be maintained in the closed state, thereby preventing any excessive increase in the pressure in the common rail.

According to the other embodiment of the method of the present invention, the pressure in the common rail can be increased rapidly even during low speed rotation for starting the engine, thereby improving the starting performance.

These and other objects, arrangements and effects of the present invention will become more apparent upon reading the following description.

BRIEF DESCRIPTION OF THE DRAWINGS

FIG. 7 is a diagram showing a driving current supplied to the electromagnetic valve, the state of operation (opening/closing) of the electromagnetic valve corresponding to the driving current, the plunger displacement, and changes in the pressure in the plunger chamber;

FIG. 8 is a graph showing the relationship between the displacement of the plunger from the bottom dead point and the time required for the displacement;

FIG. 9 is a graph showing the relationship between the pump discharge Q and the difference $T_T$ between the time at which the plunger lower dead point is reached and the time at which the electromagnetic valve is closed;

DESCRIPTION OF THE PREFERRED EMBODIMENTS

Figure 1:
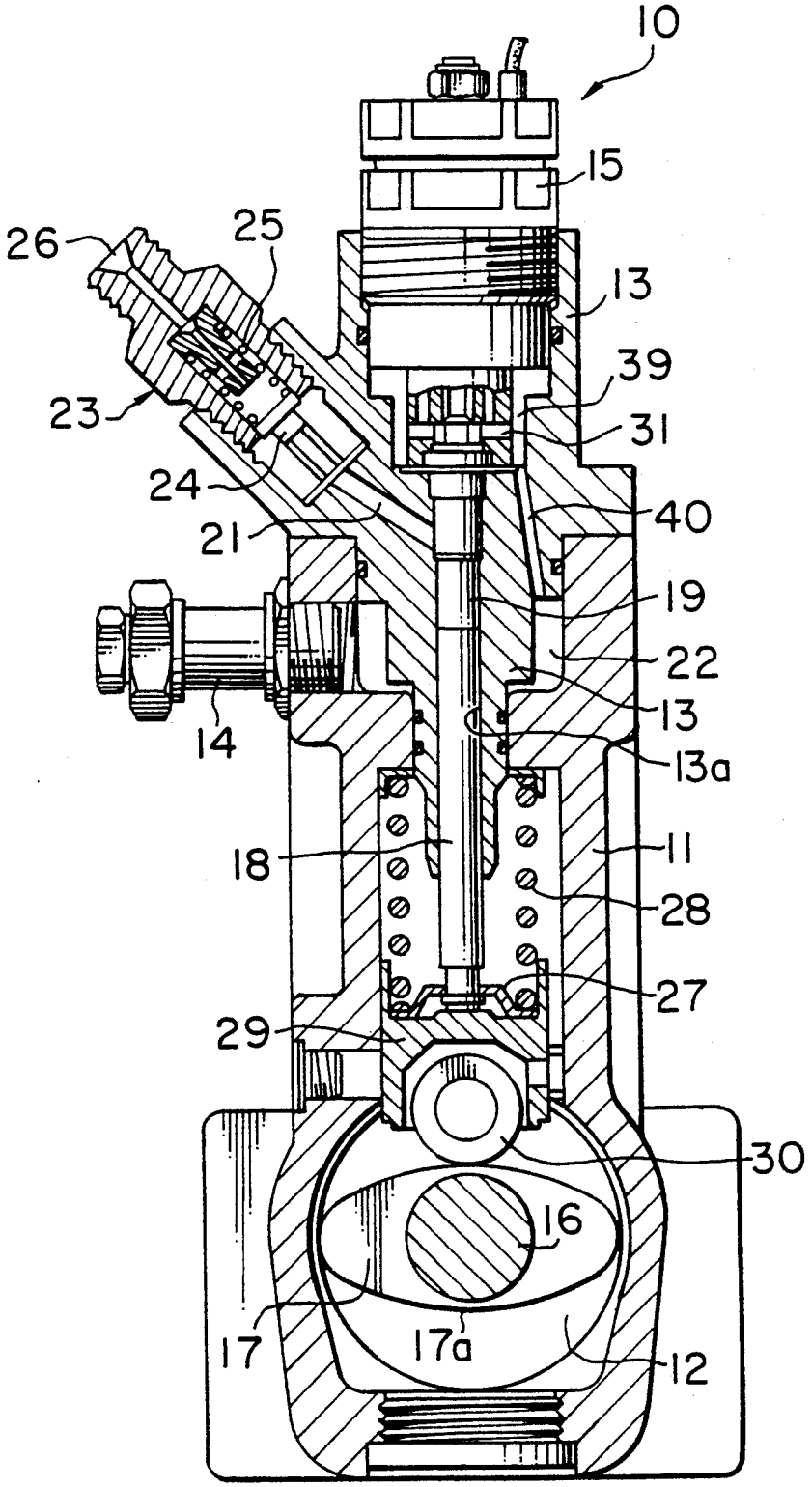
FIG. 1 is a longitudinal sectional front view of an embodiment of the present invention.

Referring to FIG. 1, a variable-discharge high pressure pump 10 which represents an embodiment of the present invention is illustrated. The high pressure pump 10 has a cam chamber 12 formed in a lower end portion of a pump housing 11, a cylinder 13 fitted in the pump housing 11, an inlet pipe 14 which is attached to the housing 11 and through which a low pressure fuel supplied from an unillustrated low pressure pump is introduced into the cylinder 13, and an electromagnetic valve 15 screwed into the cylinder 13.

A cam shaft 16 which rotates at a speed ½ of the rotational speed of the diesel engine extends through the cam chamber 12. A generally elliptical cam 17 is attached to the cam shaft 16. That is, while the diesel engine makes two revolutions to complete one cycle, the cam shaft 16 is driven to make one revolution.

The cylinder 13 has a slide hole 13*a* in which a plunger 18 is accommodated reciprocatively movably. The plunger 18 has a cylindrical shape and has no lead or the like. A plunger chamber 19 is defined by the plunger 18 and the slide hole 13*a* of the cylinder 13. A communication hole 21 is bored in the cylinder 13 so as to communicate with the plunger chamber 19. The inlet pipe 14 communicates with a fuel reservoir 22 formed between the cylinder 13 and the pump housing 11. The low-pressure fuel is supplied to the fuel reservoir 22 from the unillustrated low pressure pump through the inlet pipe 14.

A check valve 23 is attached to the cylinder 13 and communicates with the plunger chamber 19 through the communication hole 21. In the check valve 23, a valve plug 24 is forced to open the valve against a resultant force of the urging force of a return spring 25 and the fuel pressure in an unillustrated common rail by the fuel pressurized in the plunger chamber 19, thereby enabling the fuel to be ejected through an ejection hole 26 which communicates with the common rail via an unillustrated piping.

A spring seat 27 is connected to the plunger 18 at the lower end of the same. The spring seat 27 is pressed against a tappet 29 by a plunger spring 28. A cam roller 30 is rotatably attached to the tappet 29 and is brought into contact, under pressure, with the cam 17 disposed in the cam chamber 12 by the urging force of the plunger spring 28. The plunger 18 can therefore be moved reciprocatively by the cam roller 30 and the spring seat 27 which move in the longitudinal direction of the cylinder by following the contour 17*a* of the cam 17, as the cam shaft 16 rotates. The displacement and the speed of the reciprocative movement of the plunger 18 with respect to a certain rotational angle of the cam 17 are determined by the contour 17*a* of the cam 17.

Figure 2:
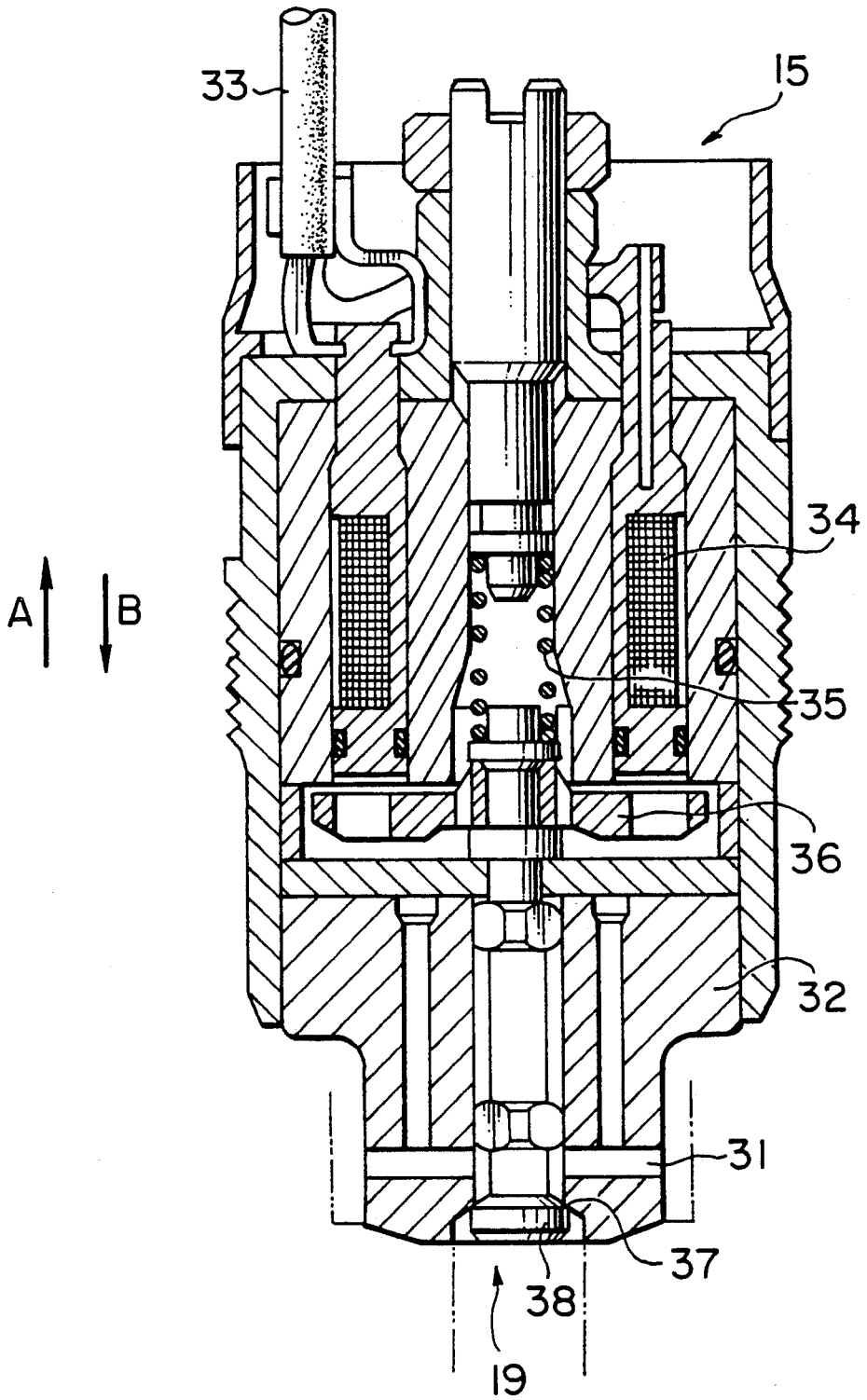
FIG. 2 is a longitudinal sectional view of the electromagnetic magnetic valve shown in FIG. 1.

The electromagnetic valve 15 is screwed into an lower end portion of the cylinder 13 so as to face the plunger 18. As shown in FIG. 2, the electromagnetic valve 15 has: a body 32 in which low pressure passages 31 are formed so as to open at their inner ends into the plunger chamber 19; an armature 36 attracted in the direction of the arrow A of FIG. 2 against the urging force of a spring 35 (applied in the direction of the arrow B of FIG. 2) by the magnetic force of a solenoid 34 energized through a lead wire 33; and a mushroom valve plug 38 which is an opening-out valve capable of opening and closing the low pressure passages 31 by being moved integrally with the armature 36 to be fitted to or moved apart from a seat 37 formed at a plunger chamber 19 opening portion. The pressure of the fuel in the plunger chamber 19 is applied as a pressing force in the valve closing direction (in the direction of the arrow A of FIG. 2) to the valve plug 38. The electromagnetic valve 15 is a pre-stroke-control type of electromagnetic valve which serves to set the time at which pressurizing the plunger 18 is started by being energized at a predetermined time so as to fit the valve plug 38 to the seat 37. As shown in FIG. 1, the low pressure passages 31 communicate at their outer ends with the fuel reservoir 22 via a gallery 39 and a passage 40.

The embodiment of the present invention is characterized in that the plunger chamber 19 and the inlet pipe 14 communicate with each other through the fuel reservoir 22 and the electromagnetic valve 15 alone, and both the introduction of the low pressure fuel into the plunger chamber 19 and the return of the low-pressure fuel to the fuel reservoir 22 are effected through the electromagnetic valve 15.

Figure 15:
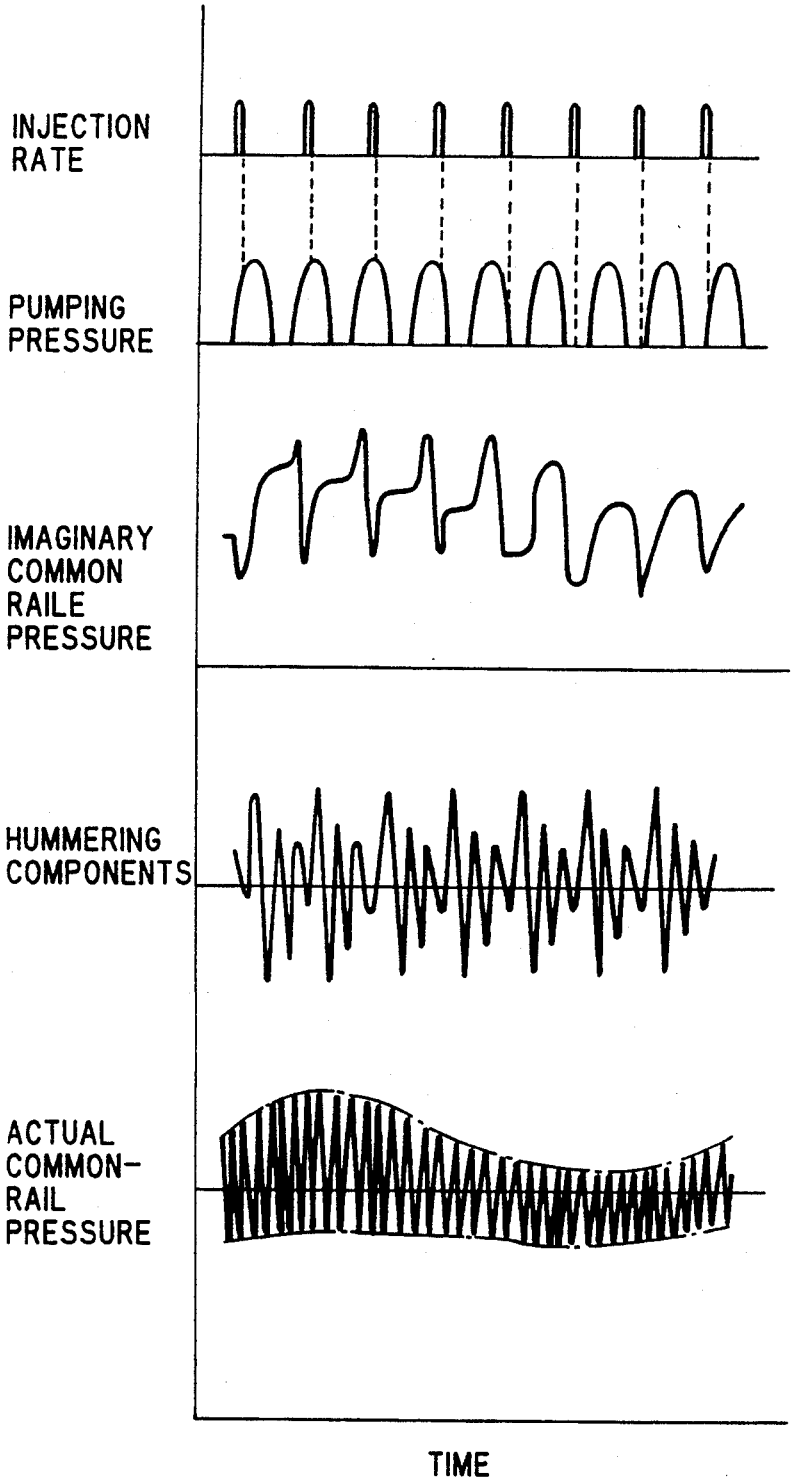
FIG. 15 graphically illustrates the pressure characteristic of the common rail obtained when the fuel injection timing and the fuel pumping timing per unit of rotation are offset.

The difference between the present invention and the conventional art will become more clear after examination of the construction of a conventional high pressure pump shown in FIG. 15. In FIG. 15, the same reference characters as those in FIG. 1 designate identical or equivalent portions or members, and the description for them will not be repeated.

As can be seen in FIG. 15, a conventional high pressure pump 10*a* is provided with feed holes 20 which communicate with the fuel reservoir 22, and the low pressure fuel is supplied to the fuel reservoir 22 through the inlet pipe 14 and the feed holes 20. Also, the low pressure fuel is supplied to the plunger chamber 19 through the inlet pipe 14 and the feed holes 20. That is, the feed holes 20 serving as a fuel inlet of the plunger chamber 19 and the low pressure passages 31 serving as an outlet for the return flow constitute different fuel passages. The feed holes 20 are opened or closed by the plunger 18, and the low pressure fuel is supplied to the plunger chamber 19 through the feed holes 20 when the feed holes 20 are not closed by the plunger 18. The high pressure pump thus constructed in accordance with the conventional art entails the problem of failure to control the pressure of the fuel if a valve accident takes place in which the valve plug 38 of the electromagnetic valve 15 is fixed in the valve closing state so that the pressure of the fuel ejected through the check valve 23 increases abruptly.

In accordance with the present invention, the feed holes 20 are removed and the low pressure passages 31 of the electromagnetic valve 15 also serve as a fuel supply passage, so that the fuel introduced into the fuel reservoir 22 is supplied to the plunger chamber 19 via the passage 40 formed in the cylinder 13, the gallery 39 and the low pressure passages 31 formed in the electromagnetic valve 15. Part of the fuel returns from the plunger chamber 19 to the fuel reservoir 22 by flowing in a direction opposite to the direction of the supply flow to the plunger chamber 19. In the thus-constructed pump, the supply of the fuel to the common rail is completely stopped if a valve accident takes place in which the valve plug 38 of the electromagnetic valve 15 is fixed in the valve closing state.

Figure 3:
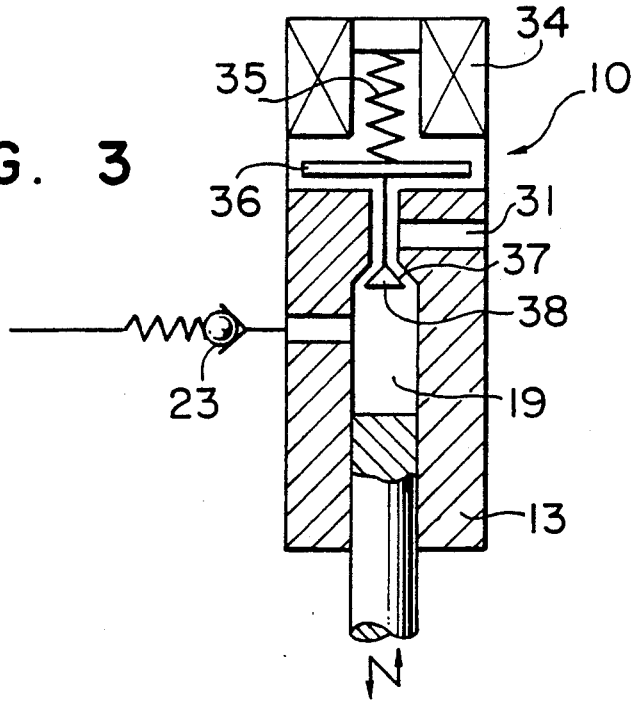
FIG. 3 is a diagram of essential portions of the arrangement shown in FIG. 1.

FIG. 3 schematically illustrates essential portions of the high pressure pump 10.

Figure 4:
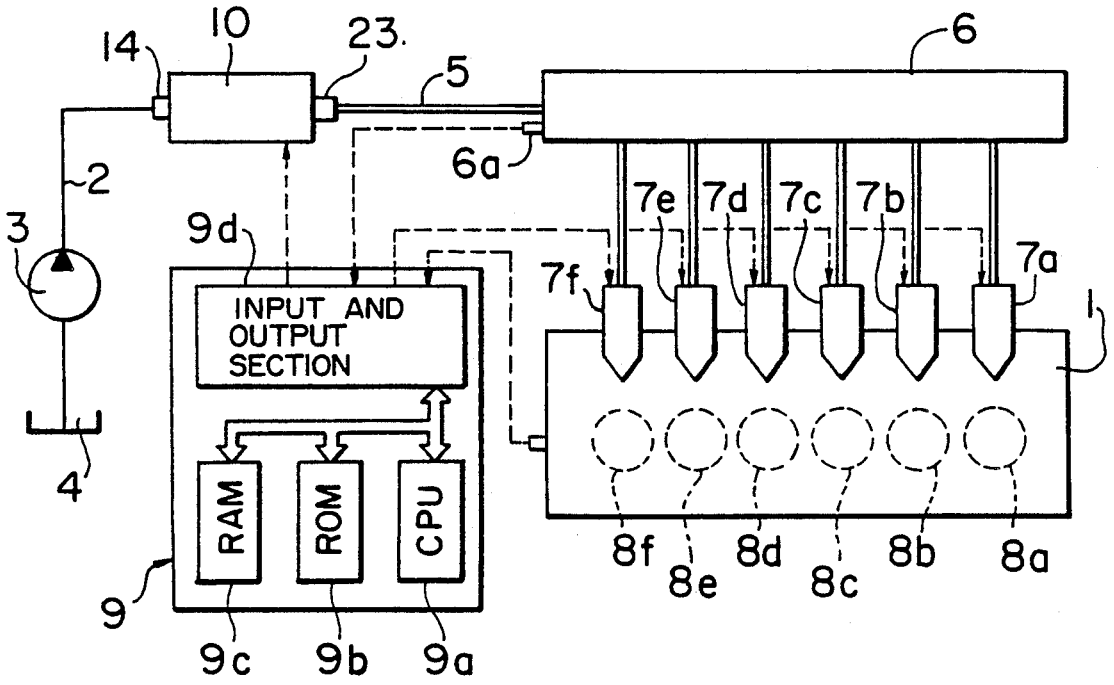
FIG. 4 is a diagram of the construction of an engine fuel controller including the embodiment shown in FIG. 1.

Referring to FIG. 4, the inlet pipe 14 of the high pressure pump 10 communicates with a fuel tank 4 through a low pressure passage 2 and a low pressure supply pump 3, and the ejection hole 26 of the check valve 23 communicates with a common rail 6 through a high pressure fuel passage 5. The common rail 6 is connected to injectors 7*a* to 7*f* corresponding to cylinders 8*a* to 8*f* of a diesel engine 1. A controller 9 is provided which has a CPU 9*a*, a ROM 9*b*, a RAM 9*c* and an input/output section 9*d* and which outputs valve opening/closing signals to the injectors 7*a* to 7*f* while being valve supplied with necessary data from the engine 1 and the common rail 6.

In this arrangement, during the downward movement of the plunger 18, the solenoid 34 of the electromagnetic valve 15 is not energized and the valve plug 38 is maintained in a valve opening state by the urging force of the return spring 35. The low pressure fuel supplied from the supply pump 3 therefore flows into the plunger chamber 19 via the inlet pipe 14, the fuel reservoir 22, the return outlet 31 of the electromagnetic valve 15 and the valve plug 38. At an initial stage of the upward movement of the plunger 18, the valve plug 38 is still in the opening state, and part of the fuel contained in the plunger chamber 19 is returned to the fuel reservoir 22 via the valve plug 38, the low pressure passages 31 and the gallery 39. If at this time the solenoid 34 is energized, the solenoid has an attraction force larger than the urging force of the return spring 35, thereby setting the valve plug 38 in a valve closing state. The fuel pressure in the plunger chamber 19 thereby increases. When this fuel pressure exceeds the sum of the urging force of the return spring 25 of the check valve 23 and the fuel pressure in the common rail 6, the check valve 23 opens to allow the fuel to be supplied under pressure to the common rail 6 through the high pressure passage 5. After this pressure feed has been completed, the energization of the solenoid 34 of the electromagnetic valve 15 is stopped, thereby setting the valve plug 38 in the valve opening state. The control of the high pressure pump 10 effected by energizing or de-energizing the solenoid 34 in synchronization with the rotation of the diesel engine 1 on the basis of a signal from a sensor 100 for detecting the angular position of the cam 17 is hereinafter called as "ordinary control". During the ordinary control, the energization/non-energization times may be selected to change the pressure feed stroke of the plunger 18 and, hence, the fuel pressure in the common rail.

Figure 5:
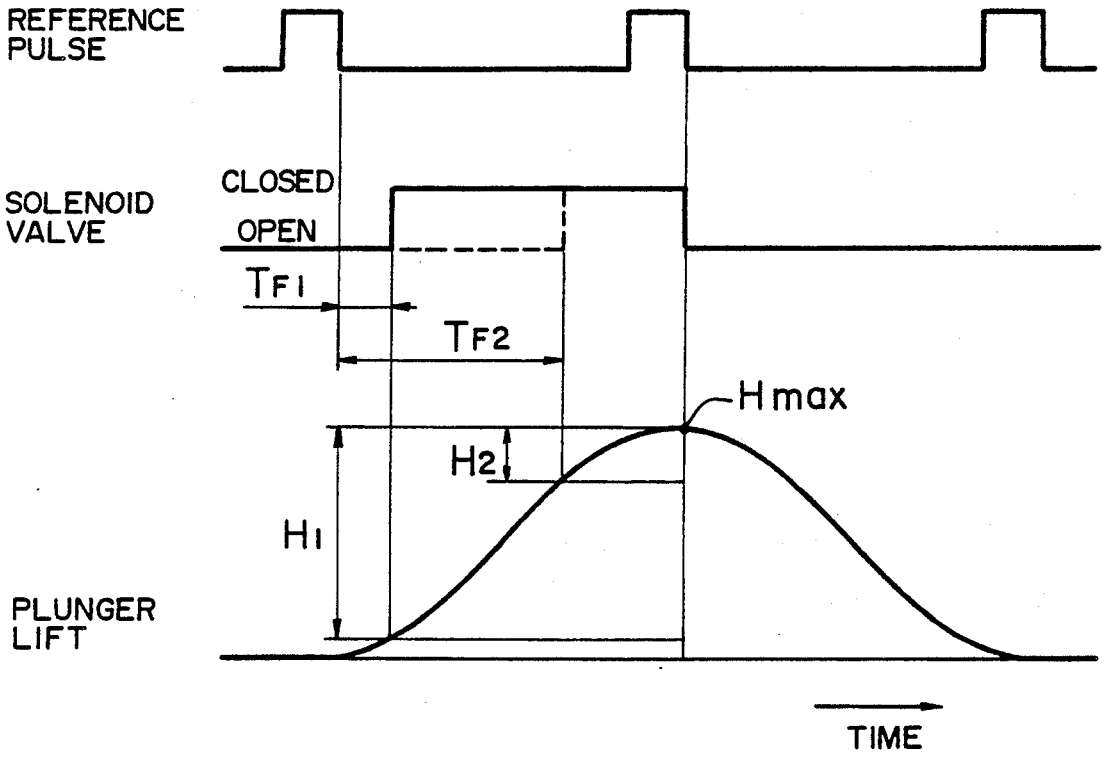
FIG. 5 is a diagram of the electromagnetic valve opening and closing times and the plunger lift during ordinary control using reference pulses.

FIG. 5 shows an example of the lift H of the plunger 18 of the high pressure pump 10 with time during the ordinary control. An electromagnetic valve control signal represents a valve closing instruction a control time $T_{F1}$ after the output of a reference pulse. At this time, the plunger 18 has already been lifted to a predetermined extent. When the electromagnetic valve 15 is closed, the pressure feed of the fuel from the high pressure pump is started, thereby supplying the mount of fuel corresponding to a stroke defined between this lift and the full lift $H_{max}$ ($H_1$ shown in FIG. 5) to the common rail 6 under pressure.

If the signal for closing the electromagnetic valve 15 is issued a control time $T_{F2}$ after the reference pulse, the lift of the plunger 18 determined at this time is large, and the pressure feed stroke is correspondingly small as defined by $H_2$. Thus, the pressure feed amount is reduced if the control time is increased, or the pressure feed amount is increased if the control time is reduced. It is therefore possible to control the pressure feed amount by selecting the time at which the electromagnetic valve 15 closing signal is issued.

Even if during the operation of the high pressure pump 10 the electromagnetic valve 15 is fixed in the closed state, and if the plunger 18 is moved downward in this state, the fuel supplied to the electromagnetic valve 15 from the supply pump 3 does not flow into the plunger chamber 19. Accordingly, when the plunger 18 is moved upward, the fuel is not supplied to the common rail under pressure, and there is no possibility of the injector 7 being damaged.

In a case where the return spring 35 loses the force of urging the valve plug 38 by, for example, being broken, the valve plug 38 is moved to open the valve by the effect of the difference between the pressures in the gallery 39 and the plunger chamber 19 as the plunger 18 is moved downward, thereby allowing the fuel supplied to the electromagnetic valve 15 from the supply pump 3 to flow into the plunger chamber 19. As the plunger is thereafter lifted, the pressure in the plunger chamber 19 becomes higher than the pressure in the gallery 39. At this time, the valve plug 38 is moved to close the valve since the return spring 35 has no urging force, and the fuel inside the plunger chamber 19 is pressurized and is supplied to the common rail 5 through the check valve 23 under pressure. That is, the fuel is supplied to the common rail 6 under pressure even if the solenoid 34 of the electromagnetic valve 15 is energized. The pressure in the common rail 6 is thereby abruptly increased, there is therefore a risk of damage to the members of the fuel injector.

Figure 6:
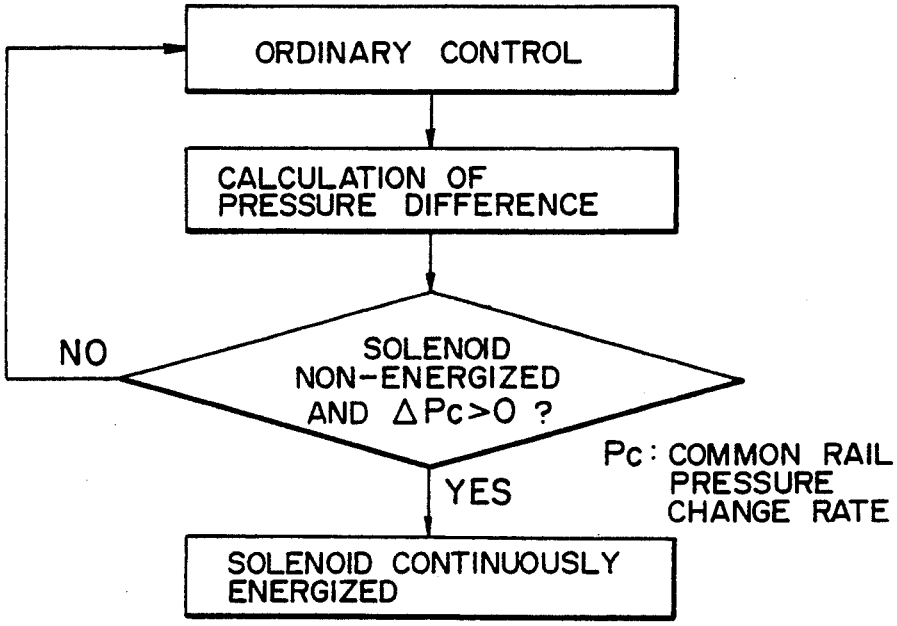
FIG. 6 is a flow chart of electromagnetic valve control relating a case where the return spring of the electromagnetic valve is broken.

FIG. 6 shows a flow chart of a method of preventing this risk. In the process of FIG. 6 involving the ordinary control, if the rate at which the pressure in the common rail changes becomes positive during the non-energized state of the solenoid 34, it is determined that an abnormality of the electromagnetic valve 15 takes place, and the solenoid 34 is continuously maintained in the energized state. The signal indicating that the pressure change rate is positive can be obtained by the calculation of a signal from a pressure sensor 6a provided in the common rail 6, which calculation is performed by the controller 9. The controller 9 outputs the valve closing signal to the electromagnetic valve 15. In this control process, the electromagnetic valve 15 is maintained in the closed state, thereby preventing the fuel from flowing into the plunger chamber 19 of the high-pressure pump 10 and, hence, from being supplied to the common rail under pressure.

Figure 7:
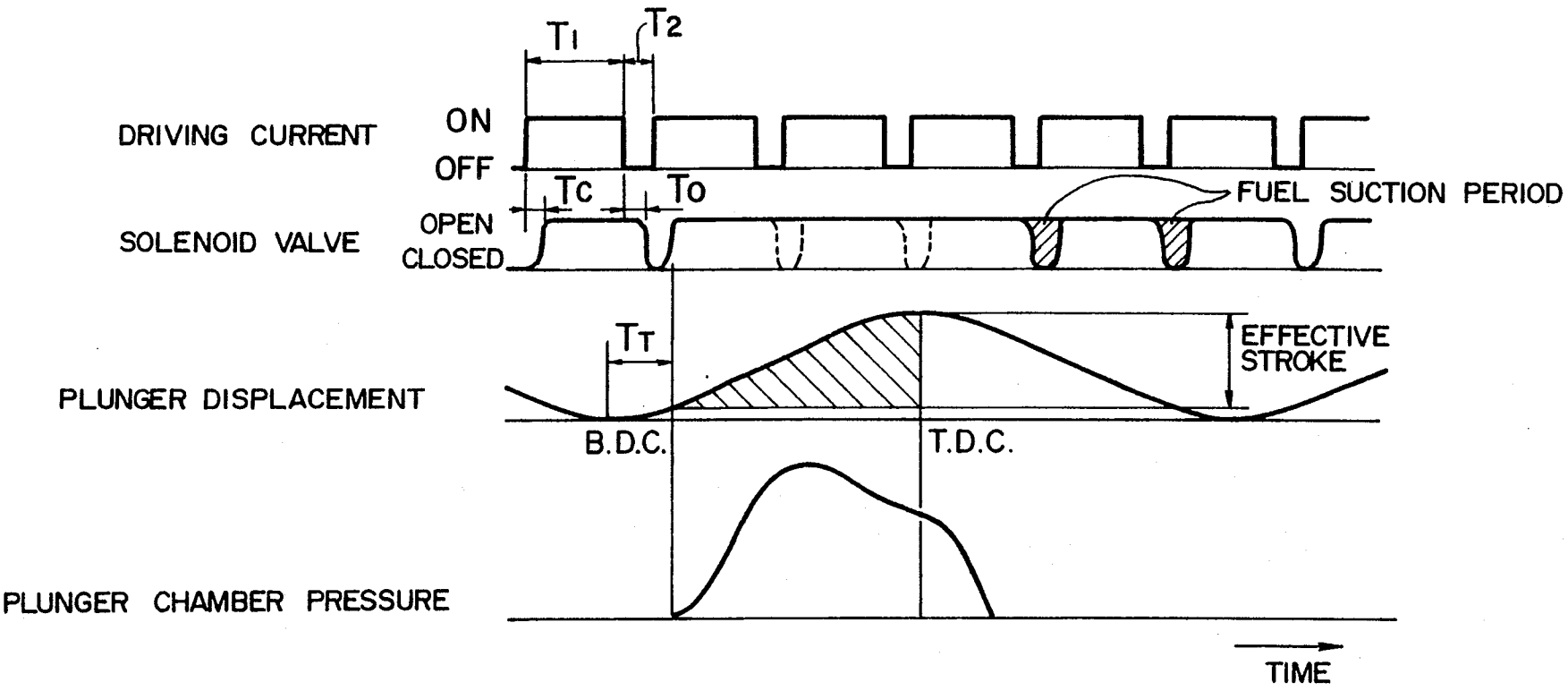
FIGS. 7 to 9 are diagrams showing a method of control for starting the engine.
Figure 8:
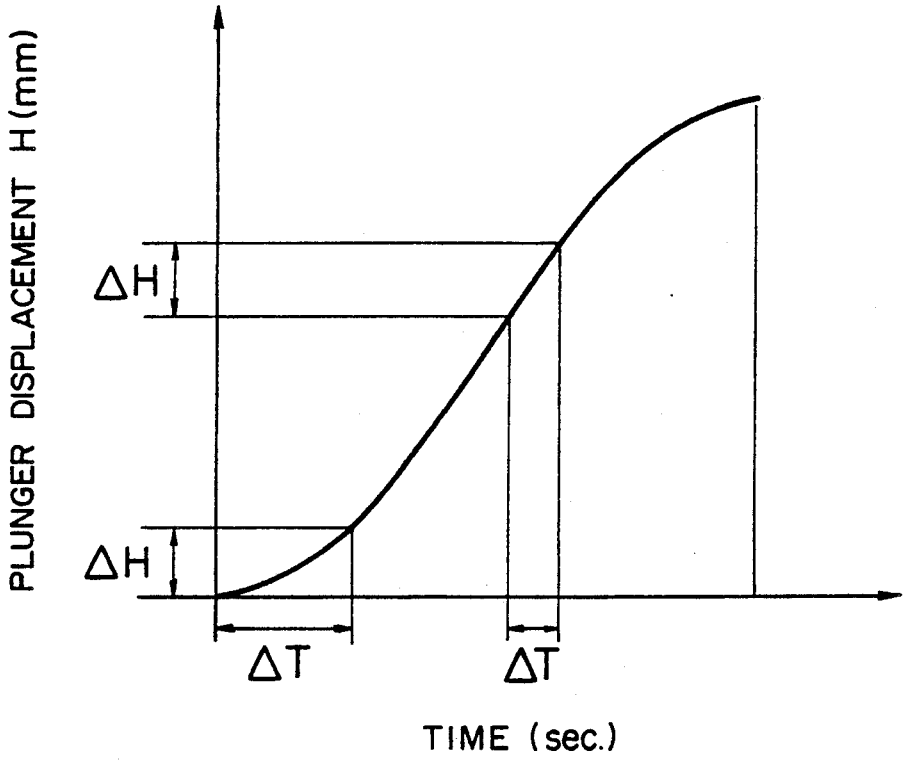
Figure 9:
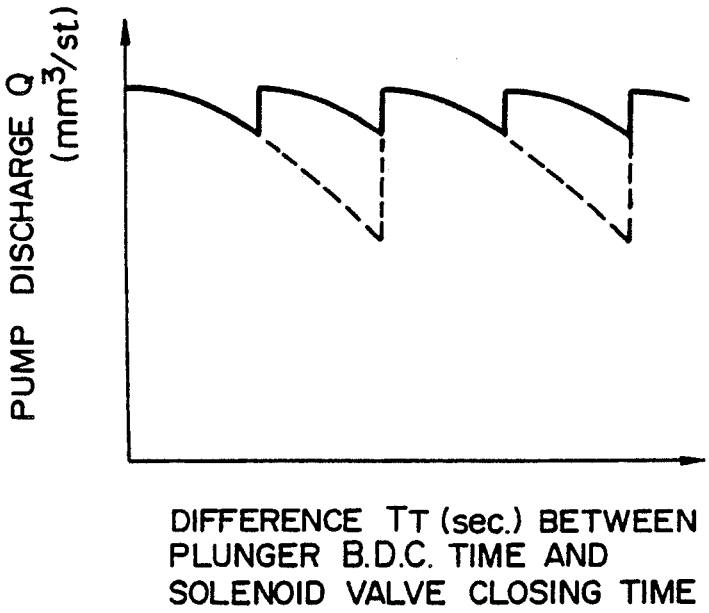

FIGS. 7 to 9 are diagrams of a method of abruptly increasing the pressure in the common rail 6 when the engine is started by using the high pressure pump in accordance with this embodiment.

At the time of starting, the engine rotates at a low speed, and, if the electromagnetic valve 15 is controlled in the ordinary control manner, it takes a long time to increase the pressure in the common rail 6 due to lack of voltage for the CPU 9a or lack of output from the cam 17 angle sensor 100. To avoid this problem, as shown in FIG. 7, pulse signals asynchronous with the revolutions of the high pressure pump 10 and having an energization time $T_1$ and a non-energization time $T_2$ are applied to the electromagnetic valve 15. The valve plug 38 is moved to close the valve a valve closing delay time $T_c$ after the start of energization and is moved to open the valve a valve opening delay time $T_0$ after the start of non-energization. The plunger 18 is moved upward during the time when the valve plug 38 is in the valve closing state, thereby increasing the pressure in the plunger chamber 19.

The valve plug 38 is of the opening-out type, and is maintained in the valve closing state even when the solenoid 34 is not energized, once the pressure $P_k$ in the plunger chamber 29 becomes higher than the valve closing maintenance pressure $P_1$ of the valve plug 38. The valve closing maintenance pressure $P_1$ is expressed by the following equation using the load $F_s$ of the return spring 35, the diameter $D_s$ of the seat of the valve plug 38, the supplied fuel pressure $P_f$, and $\pi$:

$$P_1 = \frac{F_s}{\pi \cdot D_s^{2/4}} + P_f$$

During the valve closing maintenance state of the valve plug 38, the pressure in the plunger chamber 19 is increased as the plunger 18 is moved upward, thereby supplying the fuel to the common rail 6 through the check valve 23 under pressure.

After plunger 18 has been moved downward so that the pressure in the plunger chamber 19 becomes lower than the valve closing maintenance pressure $P_1$ of the valve plug 38, the valve plug is moved so as to repeat the valve opening/closing operations by the pulse current flowing through the solenoid 34. Thus, during the valve opening state of the valve plug 38, the fuel flows into the plunger chamber 19 via the valve plug 38.

The setting of the energization time $T_1$ and the non-energization time $T_2$ in accordance with this pulse control will be explained below.

The energization time $T_1$ is obtained which is required to produce, during the minimum speed rotation for starting the engine, the pressure in the plunger chamber 19 to maintain the valve plug 38 in the valve closing state, after the plunger 18 of the high pressure pump 10 has started moving upward from the bottom dead point. The average lifting displacement $\Delta H$ of the plunger 18 for producing the valve closing maintenance pressure $P_1$ can be obtained by the following equation using the supplied fuel pressure $P_f$, the fuel capacity V, the bulk modulus E of the fuel, the diameter $D_k$ of the plunger, and $\pi$:

$$\Delta H = \frac{(P_1 - P_f) \cdot V}{E \cdot \pi \cdot D_k^{2/4}}$$

As shown in FIG. 3, a limit of the fuel capacity V is defined at the seat of the check valve 23 provided that the check valve 23 opening pressure is larger than the valve closing maintenance pressure $P_1$ of the valve plug 38.

The time $\Delta T$ required to displace the plunger 18 by $\Delta H$ is maximized at the plunger bottom dead point, as shown in FIG. 8. Let the time $\Delta T$ required to displace the plunger 18 by $\Delta H$ from the bottom dead point during the minimum rotation for starting the engine be $T_3$, and the valve closing time delay for the operation of the valve plug 38 be $T_c$. Then, the energization time $T_1$ is expressed by the following equation:

$$T_1 = T_3 + T_c$$

In accordance with fuel drawing conditions, the non-energization time $T_2$ is set to enable the maximum fuel discharge $Q_{max}$ to be drawn during one valve opening period, as expressed by the following equation:

$$T_2 = \frac{Q_{max}}{C \cdot S \cdot \sqrt{P_f - P_k}} + T_0 - T_c$$

where C represents a constant determined by physical properties including the viscosity of the fuel, and S represents the flow passage area.

In FIG. 9, the solid line indicates the pump discharge Q $mm^3/st$ with respect to the difference $T_T$ between the time at which the plunger 18 is positioned at the bottom dead point and the time at which the electromagnetic valve 15 is closed. If in this case the pulse control period $(T_1+T_2)$ is doubled, the pump discharge changes as indicated by the broken line, that is, the change in the discharge Q becomes larger and the average discharge becomes reduced. Accordingly, it is possible to reduce the change in the discharge Q while increasing the average discharge by reducing the period $(T_1+T_2)$, thereby enabling the pressure in the common rail 6 to be increased faster. The energization time $T_1$ and the non-energization time $T_2$ for pulse control are determined on the basis of this examination.

Figure 11:
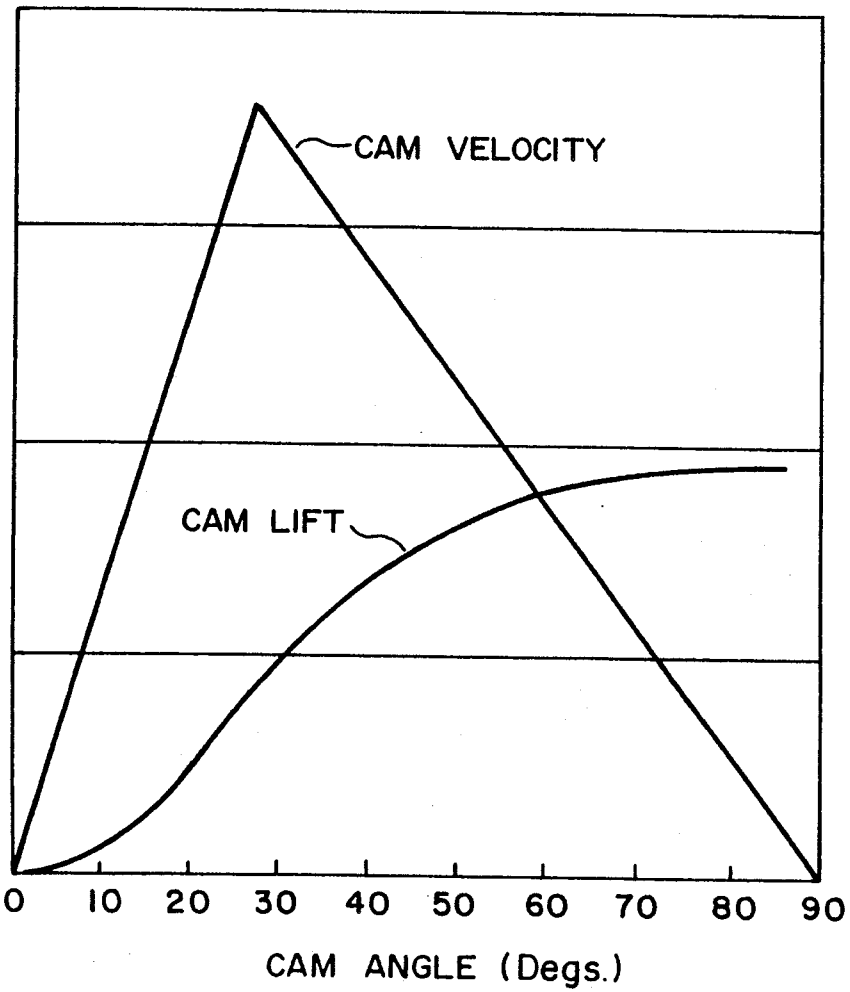
FIG. 11 is a graph of the cam velocity and the lift with respect to the cam angle.
Figure 10:
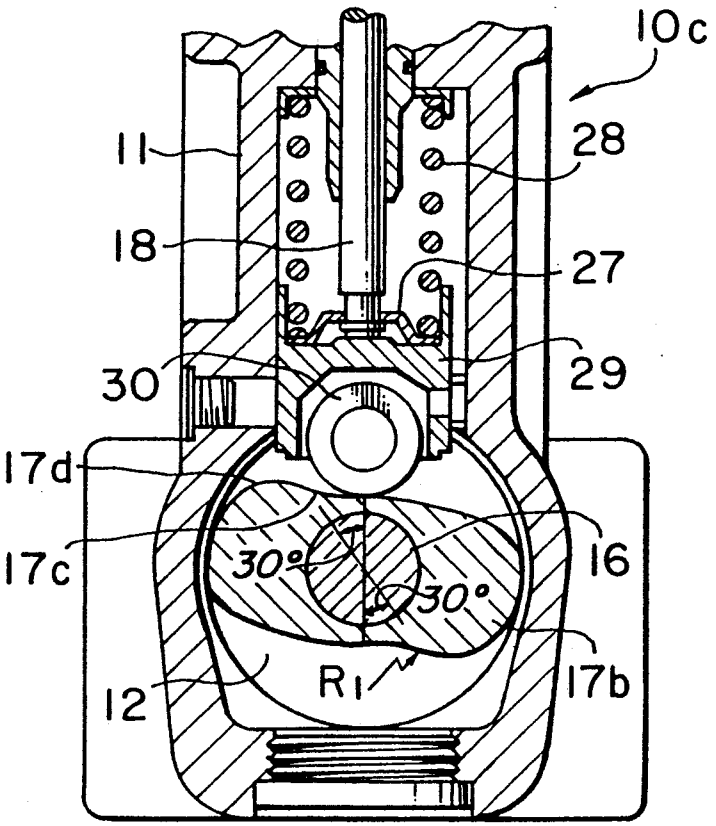
FIG. 10 is a longitudinal sectional front view of a part of variable-discharge high pressure pump which represents another embodiment of the present invention.

Referring then to FIG. 10, a high pressure pump 10*c* which represents another embodiment of the present invention is illustrated in section. In this embodiment, a cam 17*b* has a generally elliptical cam profile defined by concave circular-arc cam surfaces 17*c* and other curved cam surfaces 17*d*. Assuming that the point in the cam profile corresponding to the bottom dead point of the plunger 18 defines a cam angle of 0°, the curved surface 17*c* is formed between cam angles of 0° and about 30° with a curvature of $R_l$ the center of which is outside the cam 17*b*. The center of curvature of the surfaces 17*d* is inside the cam 17*b*. The plunger 18 reaches the to dead point at a cam angle of 90°. Because a portion of the cam profile corresponding to an initial stage of the up stroke is defined by the concave circular-arc surface 17*c*, the speed of upward movement of the plunger 18 is accelerated by the cam surface at this stage. FIG. 11 shows a graph of the cam velocity and the lift with respect to the angle of the cam 17*b*. As the cam angle is increased, a peak of the cam velocity is exhibited when the cam angle and the lift are small. As the cam angle is further increased until the to dead point is reached, the cam velocity decreases. The rate at which the lift is increased is larger at a stage where the cam angle is small, i.e., during the period of time corresponding to the first half of the up stroke where the lift is small. The lift increasing rate is smaller during the period of time corresponding to the second half of the up stroke where the lift is large and the cam velocity is decreasing. The cam 17*b* effects up-down strokes two times during one revolution of the cam shaft 16 and exhibits a non-constant-velocity cam curve such that the lifting speed is gradually increased during the first half of lifting and is reduced during the second half of lifting.

Next, the operation of the variable-discharge high pressure pump in accordance with this embodiment will be explained below with respect to time with reference to FIG. 12. An electromagnetic valve control signal represents an instruction for valve closing for a time $T_D$ a control time $T_{L1}$ after the output of a reference pulse from the cam angle sensor 100. At this time point a, the plunger 18 has been moved upward to a lift $P_1$. The electromagnetic valve 15 is opened at the time point A to start supplying the fuel under pressure. The amount of fuel corresponding to a part $S_1$ of the stroke defined between this time point and a time point C at which the plunger 18 reaches the highest point $P_3$ is thereby discharged into the common rail. In a case where the electromagnetic valve control signal represents a valve closing instruction a control time $T_{L2}$ after the reference pulse (as indicated by the broken line), i.e., at a time point B, the lift of the plunger 18 at this time point is $P_2$ and pressure feed of the fuel is only effected with a part $S_2$ of the stroke between a height $P_2$ and a height $P_3$. That is, the amount of fuel supplied to the common rail under pressure is reduced if the control time $T_L$ after the reference pulse is increased, or is increased if the control time $T_L$ is reduced. It is therefore possible to control the discharge by selecting the control time $T_L$.

Next, the relationship between the cam velocity, the control time and the plunger lift will be examined below.

Figure 12:
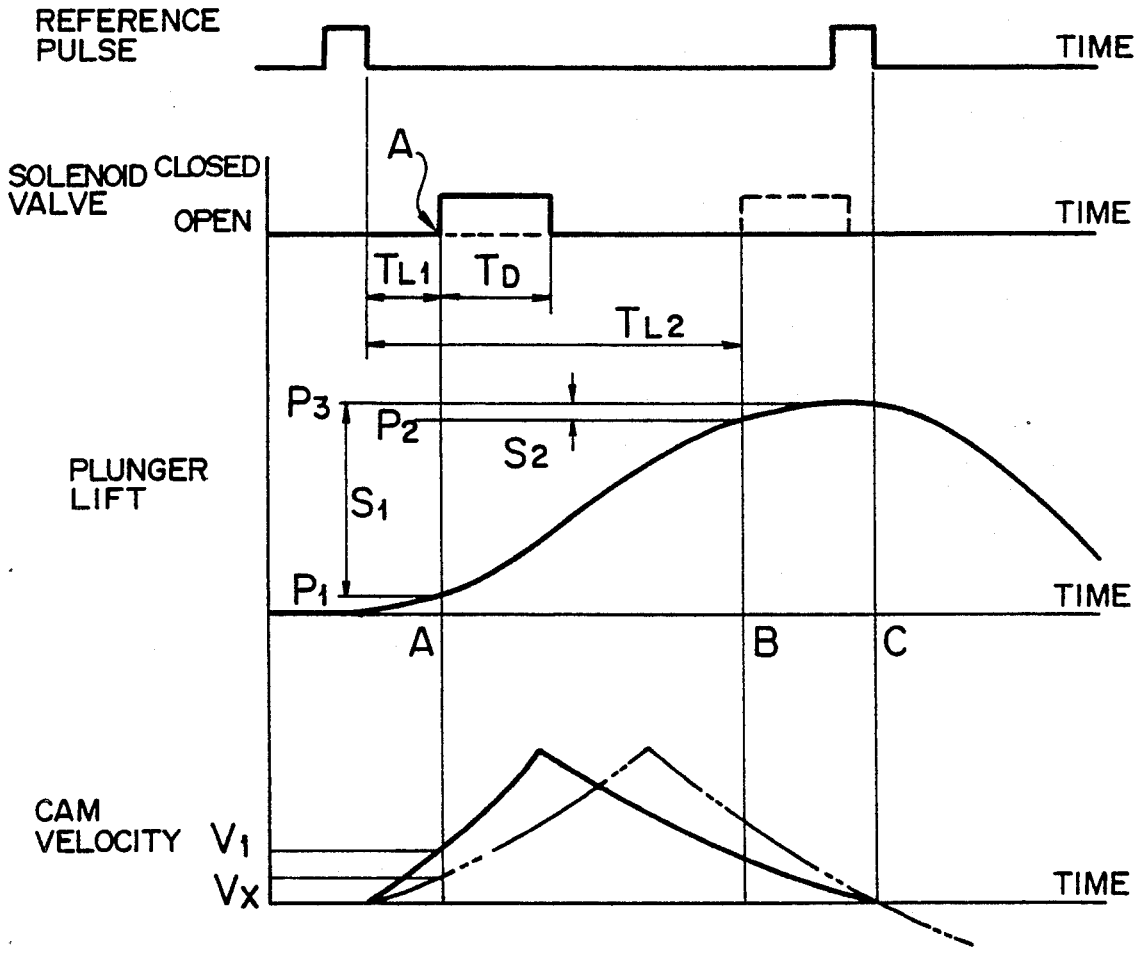
FIG. 12 is a diagram of the operation of the pump shown in FIG. 11.

Since in this embodiment the cam velocity is set to be higher for the first half of the up stroke of the plunger, the cam velocity changes with respect to time as indicated by the solid line in FIG. 12. That is, in a case where the control time $T_{L1}$ is short and the discharge is large, the cam velocity at the time point A at which pressure feed is started (when the valve is closed) is $V_1$ and increases as the pressure feed proceeds. The cam velocity exhibits a peak during the period of time corresponding to the first half of the up stroke of the plunger, and thereafter decreases gradually.

Then, the pressure feed state in the case where the cam velocity is set so as to be higher during the period of time corresponding to the second half of the plunger up stroke will be examined below for comparison with the pressure feed in the case of the variable-discharge high pressure pump in accordance with this embodiment. If the peak of the cam velocity is set for the second half, the change in the cam velocity with time is as indicated by the double-dot-dash line in FIG. 12; the cam velocity at the control start time point A is Vx. As can be understood from the graph, the cam velocity Vx is lower than the cam velocity $V_1$ at the control start time point A in the case of this embodiment.

The control signal represents the electromagnetic valve closing instruction after the control time $T_{L1}$ from the reference pulse, and allows valve opening after a period of time $T_D$.

Even when valve opening is allowed by the signal and when the electromagnetic valve is in the non-energized state, the electromagnetic valve is maintained in the closed state by the pressure in the plunger chamber if this pressure is high, since the electromagnetic valve of the variable-discharge high pressure pump in accordance with the present invention is of the opening-out type. The pressure feed is therefore continued until the plunger to dead point is reached. However, during low-speed operation or, more specifically, during the operation in a super-low-speed range for starting the engine in which a large discharge is required to promptly produce and maintain the common rail pressure, the plunger lifting speed is, in fact, lower even if the same cam profile is used, resulting in a reduction in the pressure increase rate. On the other hand, the valve closing setting time $T_D$ is minimized because it is desirable to reduce the valve closing time $T_D$, i.e., to establish the valve opening allowance state faster in order to enable the variable-discharge high pressure pump to be used for operation of a higher speed. In such as case where the cam velocity is low while the valve closing time $T_D$ is short, the fuel pressure in the plunger chamber does not increases to a level sufficient for maintaining the closed state of the electromagnetic valve, and the valve is opened before the pressure feed to be continued until the to dead point is reached is completed, thereby allowing the fuel to return to the fuel chamber. As a result, the discharge becomes naught although the signal designates the large discharge.

However, in the case of the variable-discharge high pressure pump in accordance with this embodiment, the cam velocity is peaked for the first half of the plunger up stroke and, specifically, a certain acceleration is reached immediately after the control start point. The upward movement of the plunger is thereby accelerated so that the plunger moves at a high speed. At the initial stage of plunger lifting, therefore, the pressure in the plunger chamber can be increased in a short time to a level high enough to maintain the opening-out type electromagnetic valve in the closed state. Thus, even if the valve closing setting time $T_D$ is set to be shorter in order to enable the variable-discharge high pressure pump to operate suitably even at a high speed, it is possible to set, in the short valve closing setting time $T_D$, the pressure in the plunger chamber to a level high enough to maintain the closed state of the valve. It is thereby possible to continue the pressure feed until the plunger to dead point is reached and, hence, to ensure a large discharge during super-low-speed operation even though the valve opening allowance state is established after a short time.

In a case where a large dischàrge is not required, that is, an instruction to close the electromagnetic valve is issued with a control time $T_{L2}$ delay, the cam velocity exhibited at the time point B as indicated by the solid line in FIG. 12 in the case of the cam for setting the peak for the first half of the up stroke is lower than that exhibited as indicated by the double-dot-dash line in FIG. 12 in the case of the cam for setting the peak of the cam velocity for the second half. In the case of the former type of cam, however, the pressure in the plunger chamber can be boosted more easily by the effect of the approaching period ($T_{L2}$) for opening the electromagnetic valve as well as the effect of reduction in the dead volume, and the internal pressure for maintaining the electromagnetic valve in the closed state can be obtained, thereby preventing the valve from opening again.

Thus, the variable high pressure pump in accordance with this embodiment is capable of ensuring a large discharge required during the super-low-speed operation for, for example, starting the engine while satisfying requirements for high speed operation, thereby enabling the optimum common rail pressure to be produced stably irrespective of the operating conditions.

In accordance with a still another embodiment of the present invention, a non-constant-velocity cam for creating strokes during one revolution of the cam shaft is used in place of the non-constant-velocity cam for creating two strokes during one revolution of the cam shaft in the variable-discharge high pressure pump in accordance with the above-described embodiment.

A cam in accordance with this embodiment will be described below with reference to FIGS. 13 and 14.

Figure 13:
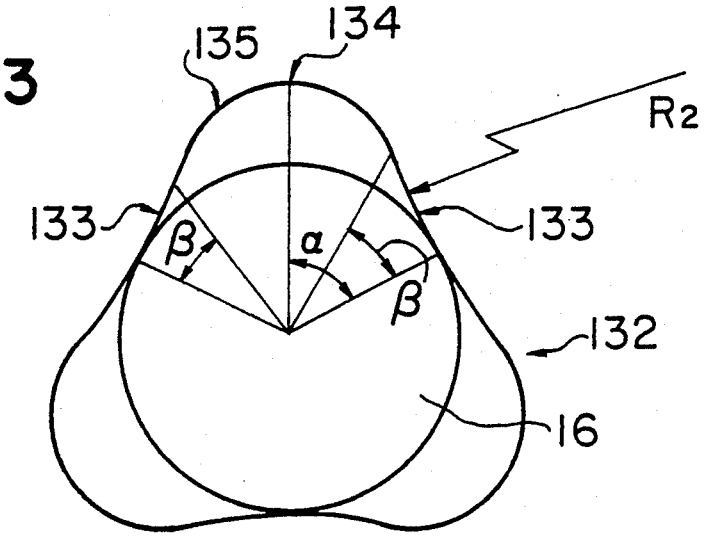
FIG. 13 is a front view of another example of the cam.

FIG. 13 is a front view of a cam 132 whose profile is as described below. It is assumed that the point in the cam profile corresponding to the bottom dead point of the plunger 18 defines a cam angle of 0°. The corresponding cam surface is formed as a concave surface 133, and a crest 134 in the cam profile corresponding to the top dead point of the plunger 18 is formed at a cam angle $\alpha$ of 60°. The concave cam surface 133 has a circular-arc contour having a curvature $R_2$ the center of which is outside the cam 132, and is defined between cam angles of 0° and 20°. Another concave surface 133 is formed through an angle $\beta$ between cam angles of about 100° and 120°. The rest of the cam surface in the range of these angles is formed as a curved surface 135 having a curvature the center of which is inside the cam 132. That is, the concave circular-arc surfaces 133 correspond to the first half of the up stroke and the second half of the down stroke, and the cam velocity is increased during the periods corresponding to these halves of the strokes. The cam 132 has other cam surfaces formed in the same manner; the crests 134 and the concave surfaces 133 are formed in three places so that the cam 132 exhibits three identical profile portions during one revolution of the cam shaft 16.

Figure 14:
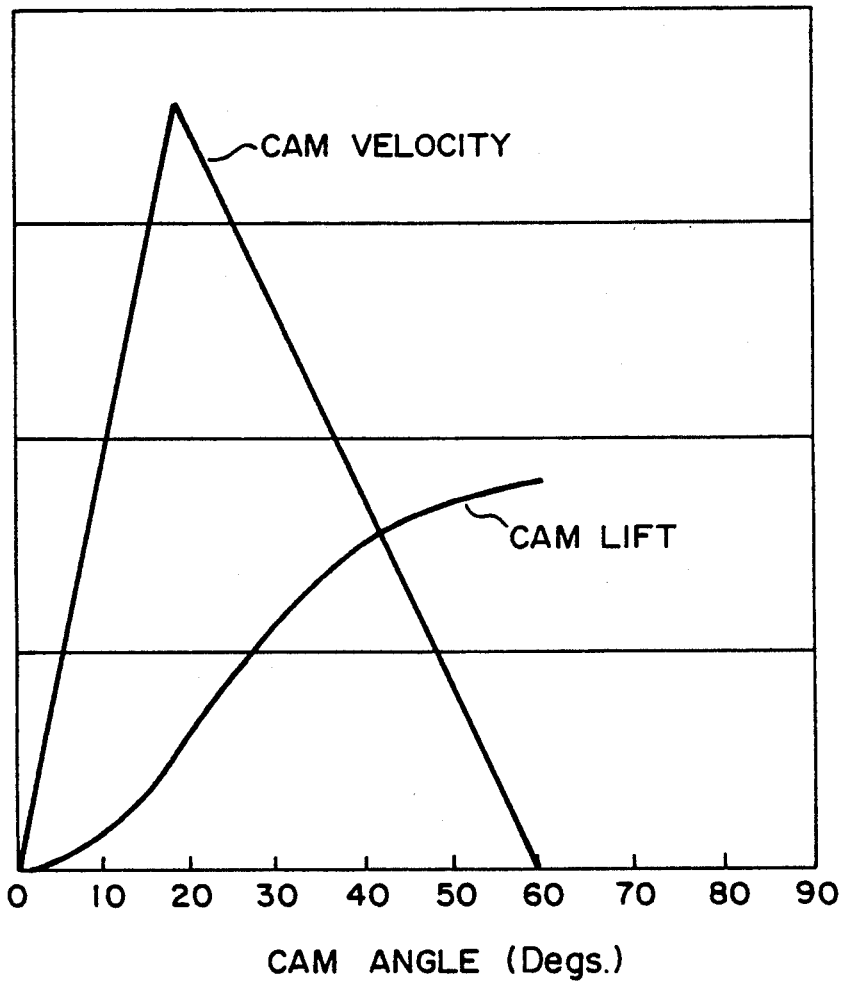
FIG. 14 is a graph of the cam velocity of the cam shown in FIG. 13 and the lift with respect to the cam angle.

FIG. 14 is a graph showing the cam velocity of the cam 132 and changes in the lift with respect to the cam angle.

The cam velocity is peaked at about a cam angle of 20° for the first half of the up stroke. During the period of time corresponding to the first half of the up stroke, the lift is small but the lift increasing rate is large. During the period of time corresponding to the second half of the up stroke where the cam velocity decreases under the peak, the lift is large but the lift increasing rate is small.

That is, the cam 132 ensures that the fuel pressure can be increased to a high pressure by the first half of the up stroke. A variable-discharge high pressure pump in which the cam 132 is used has the same performance and effects as the above-described embodiments while the rotational speed of the cam shaft 16 is lower.

When an 8-cylinder Diesel engine is equipped with three high pressure pumps each operative to discharge fuel three times per rotation of a cam shaft, as shown in FIG. 13, i.e., per unit of rotation according to a cycle of the engine, the injector associated with each of the engine cylinders performs one injection, i.e., a total of eight injections by eight injectors, per unit of the engine rotation while the fuel is discharged and pumped into the common rail three times by each pump, i.e., a total of nine times by the three pumps, as will be seen from the curves named "Pumping Pressure" in FIG. 15.

Figure 16:
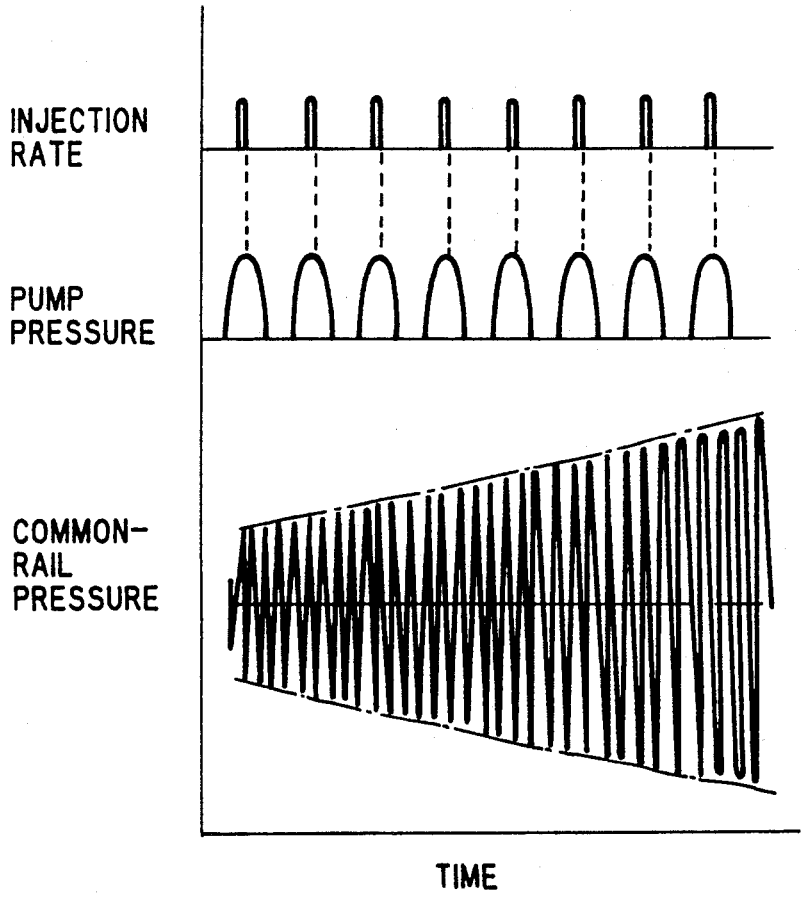
FIG. 16 graphically illustrates the pressure characteristic of the common rail obtained when the fuel injection timing and the fuel pumping timing per unit of rotation are registered.
Figure 17:
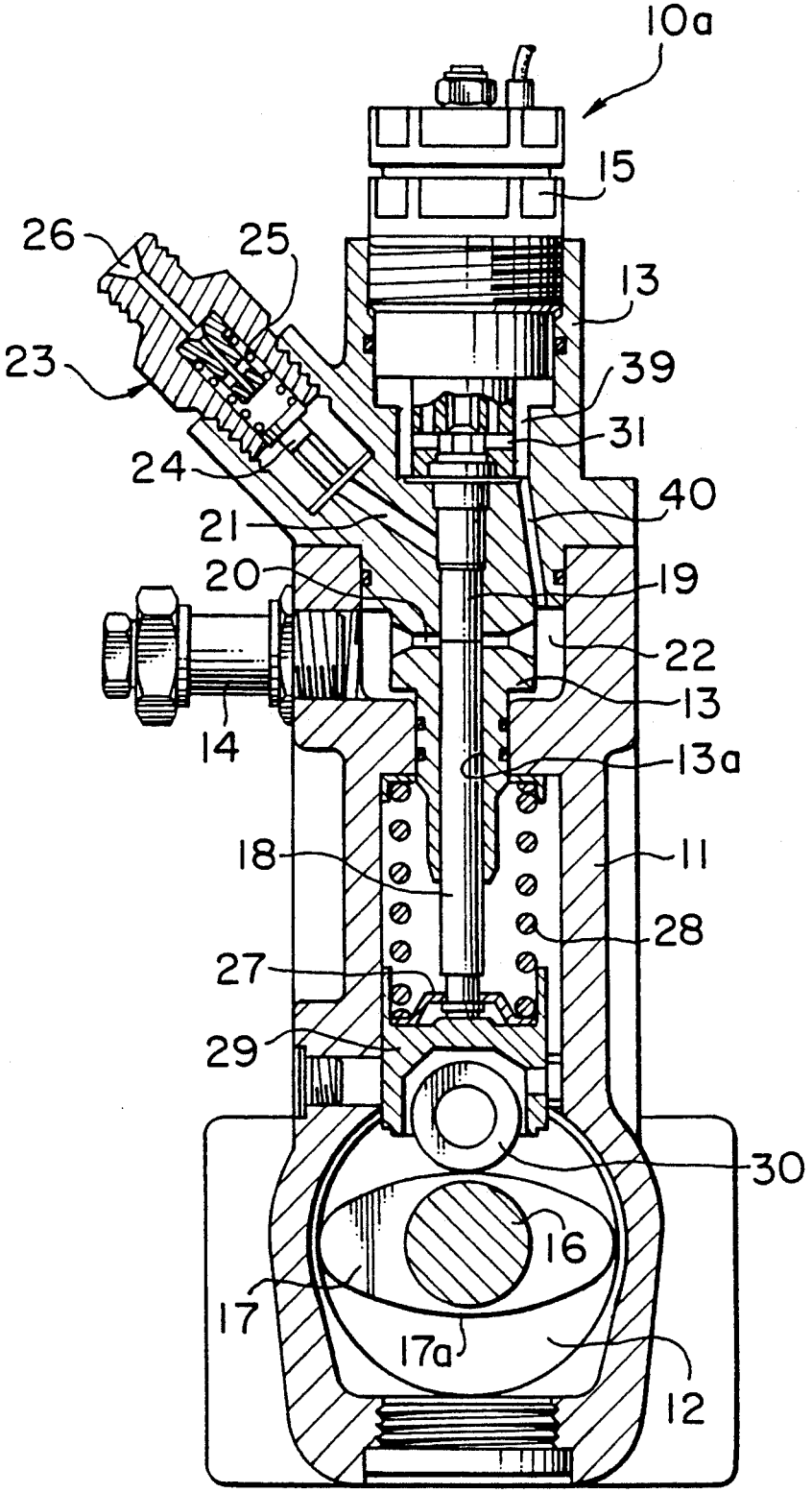
FIG. 17 is a longitudinal sectional front view of a conventional high pressure pump.

Accordingly, because the cycle of the fuel injecting operations of the injectors is not registered with the cycle of the fuel discharges by the high pressure pumps, the pressure in the common rail is varied in the manner shown by the waves named "Imaginary Common Rail Pressure" in FIG. 15. Hummerings take place when the fuel injectors are closed, as shown by the waves named "Hummering Components" in FIG. 15. The hummerings are combined with the variation in the common rail pressure caused due to the fuel injections by the injectors and the fuel discharges and pumpings by the pump, so that the actual common rail pressure is varied in the matter shown by the waves named "Actual Common Rail Pressure" in FIG. 15. The variation of the actual common rail pressure shown in FIG. 15 is greatly smaller than the common rail pressure variation obtained when the timings of fuel injections by injectors are in registry with the timings of fuel discharges by the high pressure pumps, as shown in FIG. 16.

In the example discussed above, the fuel is injected through injectors into the engine eight times per unit of rotation while the fuel is discharged and fed into the common rail nine times per unit of rotation. In general, however, the variable-discharge high pressure pump may discharge the fuel into the common rail n times per unit of rerotation, the number n being equal to the number of injections by the injectors multiplied or divided by a non-integral number.

What is claimed is:

1. A variable-discharge high pressure pump for pressurizing and pressure-feeding fuel to a common rail of a diesel engine, said pump comprising:

a plunger;

a plunger chamber in which said plunger is movably accommodated;

a cam for reciprocally moving said plunger;

an electromagnetic valve capable of opening out to the interior of said plunger chamber;

a fuel reservoir communicating with said plunger chamber through said electromagnetic valve;

a check valve communicating with said plunger chamber and capable of opening at a predetermined pressure; and an inlet pipe for supplying a low pressure fuel to said fuel reservoir;

wherein said plunger chamber and said inlet pipe communicate with each other through said fuel reservoir and said electromagnetic valve, and both the introduction of the low pressure fuel into said plunger chamber and the return of the low pressure fuel from said plunger chamber to said fuel reservoir are effected through said electromagnetic valve; and wherein a discharge of fuel from said plunger chamber into said common rail is finished when a forward stroking motion of the plunger is finished.

2. A variable-discharge high pressure pump according to claim 1, further comprising a pressure sensor for sensing that the rate at which the pressure in said common rail changes becomes positive, and a controller for energizing said electromagnetic valve in response to a signal supplied from said pressure sensor when said electromagnetic valve is not energized, wherein said electromagnetic valve is open in the non-energized state.

3. A variable-discharge high pressure pump according to claim 1, wherein said cam includes a non-constant-speed cam having a cam profile such that the cam velocity of said cam is maximized during the period of time corresponding to the first half of the stroke of said plunger for pressuring and pressure-feeding the fuel contained in said plunger chamber.

4. A variable-discharge high pressure pump according to claim 3, wherein the cam profile of said cam includes a concave circular-arc surface formed in the vicinity of a point at which the pressurization and pressure-feed stroke of said plunger is started, said concave circular-arc surface having a curvature the center of which is on the outside of said cam.

5. A method of controlling a variable-discharge high pressure pump for pressurizing and pressure-feeding fuel to a common rail of a diesel engine, the pump having: a plunger; a plunger chamber in which the plunger is movably accommodated; a cam for reciprocatively moving the plunger; an electromagnetic valve capable of opening out to the interior of the plunger chamber; a fuel reservoir communicating with the plunger chamber through the electromagnetic valve; a check valve communicating with the plunger chamber and capable of opening at a predetermined pressure; and an inlet pipe for supplying a low pressure fuel to the fuel reservoir; said method comprising the steps of:

effecting both the introduction of the low pressure fuel into the plunger chamber and the return of the low pressure fuel from the plunger chamber to the fuel reservoir mainly through the electromagnetic valve;

controlling the fuel pressure in the common rail by energizing and de-energizing the electromagnetic valve; and finishing discharge of fuel from the plunger chamber into the common rail when a forward stroking movement of the plunger is finished.

6. A method according to claim 5, wherein the periods of time for the energization and de-energization of the electromagnetic valve are in synchronization with the rotation of the diesel engine.

7. A method according to claim 5, wherein the electromagnetic valve is energized to be closed if the rate at which the pressure in the common rail changes becomes positive while the electromagnetic valve is open in the non-energized state.

8. A method according to claim 5, wherein a pulse signal asynchronous with the rotation of the diesel engine and determining an energization time and a de-energization time is applied to the electromagnetic valve when the diesel engine is started.

9. A method according to claim 8, wherein the energization time and the nonenergization time for controlling the variable-discharge high pressure pump are determined by the following equations:

$$T_1 = T_2 + T_c$$

$$T_2 = \frac{Q_{max}}{C \cdot S \cdot \sqrt{P_f - P_k}} + T_0 - T_c$$

where $T_3$: a period of time required to increase the pressure to a level high enough to maintain the electromagnetic valve in the closed state by lifting the plunger from the bottom dead point during a minimum-speed rotation for starting the engine;

$T_c$: valve closing time delay after the moment at which the electromagnetic valve is energized;

$Q_{max}$: a maximum discharge from the high-pressure pump;

C: a constant determined by factors including the viscosity of the fuel;

S: the flow passage area;

$P_f$: supplied fuel pressure;

$P_k$: pressure in the plunger chamber; and $T_0$: valve opening time delay after the moment at which the electromagnetic valve is de-energized.

10. A method according to claim 5, wherein the velocity of the plunger is maximized during the period of time corresponding to the first half of the stroke of the plunger for pressuring and pressure-feeding the fuel contained in the plunger chamber.

11. A variable-discharge high pressure pump according to claim 1, wherein the fuel fed into said common rail is injected into the engine through a fuel injector associated with each of engine cylinders and wherein the variable-discharge high pressure pump discharges the fuel into said common rail n times per unit of rotation, said n being equal to the number of injections by the injectors multiplied or divided by some number.

* * * * *